United States Patent [19]

Uher

[11] 4,440,008

[45] Apr. 3, 1984

[54] TUMBLER LOCK

[76] Inventor: Edmond Uher, Hasenlohweg 16, CH-6315 Oberägeri, Switzerland

[21] Appl. No.: 349,667

[22] Filed: Feb. 17, 1982

[30] Foreign Application Priority Data

Mar. 3, 1981 [AT] Austria ..... 14979/81

[51] Int. Cl.[3] ..... E05B 15/08; E05B 15/14; E05B 29/06

[52] U.S. Cl. ..... 70/364 R; 70/377; 70/453; 70/454

[58] Field of Search ..... 70/364 R, 376, 377, 70/419, 453, 454

[56] References Cited

U.S. PATENT DOCUMENTS

| | | | |
|---|---|---|---|
| 1,406,573 | 2/1922 | Mantanfel | 70/377 |
| 1,644,365 | 10/1927 | Bennett . | |
| 1,725,557 | 8/1929 | Baird | 70/364 R |
| 2,282,698 | 5/1942 | Biemer . | |
| 2,647,391 | 8/1953 | Uher | 70/377 |
| 3,260,080 | 7/1966 | Wellekens | 70/364 R |
| 4,292,823 | 10/1981 | Reinhard | 70/364 R |

FOREIGN PATENT DOCUMENTS 1134046 11/1968 United Kingdom .

*Primary Examiner*—Robert L. Wolfe

*Attorney, Agent, or Firm*—Lalos, Leeds, Keegan, Lett & Marsh

[57] ABSTRACT

A tumbler lock having an outer cylinder and an inner cylinder rotatably mounted therein with springless plate-shaped tumblers which move freely in guide slots. Tumbler locks of known construction can be opened by unauthorized persons because an object can be inserted through the windows in the plate-shaped tumblers required for the insertion of the key, wedged against the side faces of the windows and the tumblers lifted from their locked state. This is foreclosed in the invention because the side flanks of the windows in the area of the key guide which are parallel to the direction of the motion of the tumblers are covered by protective strips connected with the inner cylinder.

8 Claims, 4 Drawing Figures

TUMBLER LOCK

BACKGROUND OF THE INVENTION

The invention relates to a tumbler lock consisting of an outer cylinder having two longitudinal recesses staggered by 180°, with an inner cylinder rotatably mounted in the outer cylinder, with at least two springless plate-type tumblers which move freely in guide slots, the tumblers engaging, in the locked state, in one of the longitudinal recesses of the outer cylinder, thus preventing the inner cylinder from rotating. The tumblers are provided with key windows and, during the insertion of the corresponding key, move, positively controlled, in both directions of motion through the key profile from the area of the longitudinal recess to the area of the inner cylinder so that the inner cylinder can rotate to the unlocked position.

When the key is being withdrawn, tumbler locks of known construction with plate-type tumblers are locked because the tumblers engage in a longitudinal recess of the outer cylinder either by the biasing force of a spring or by gravity. The inner cylinder is thus prevented from rotating. All tumblers are locked on the bottom of the longitudinal recess and are therefore on the same level.

Such a tumbler lock can be opened with relative ease by unauthorized persons by inserting an object through the windows in the plate-type tumblers, which are wedged on the side faces of the windows. All the tumblers located in the same plane can be lifted off the longitudinal recess until they come to rest within the dimensions of the rotatable inner cylinder, so that the inner cylinder can be turned. Means for carrying out this procedure are known, and, thus, these types of locks only offer limited safety. Particularly in locks in which the tumblers are not spring-loaded, this procedure can be easily applied because of the free movability of the plates.

More expensively designed locks are known in which the above-mentioned disadvantage can be overcome by plunging the spring-loaded tumbler plates into the longitudinal recess at different depths using stops and projections or lugs. When all the tumblers are lifted together, some of them will engage in the upper or lower longitudinal recesses in the outer cylinder, preventing the lock from opening. Although this measure prevents the lock from easily being opened by lifting all the tumblers, it does not rule out the possibilty of tracing the locking edges on the individual tumblers. Thus, a burglar equipped with the known and necessary tool has no difficulty opening such a lock.

The inner cylinder must be rotated as the locking edges are being traced, so that the tumblers rub with their locking edges in the guide slots. The locking edges can then be traced during the lifting of the tumblers. Locks are known which render this tracing difficult. For this purpose, the tumblers and, accordingly, the longitudinal recess in the outer cylinder of the lock in which the tumblers engage in the closed state, are provided with profiles and hookings to prevent the inner cylinder from rotating easily. This measure renders unauthorized opening of the lock more difficult. However, since there is the possibility of manipulating objects, which are inserted in the key channel, directly on the tumblers, it is only a question of time and skill to open such a lock.

OBJECTS OF THE INVENTION

Therefore, it is an object of the invention to provide a tumbler lock with plate-type tumblers, which is better protected against unauthorized openings without a key and is at the same time simple in design, inexpensive to make, and reliable in use.

Other objects and advantages of the present invention will become more apparent to those persons having ordinary skill in the art to which the present invention pertains from the following description taken in conjunction with the accompanying drawings.

THE DRAWINGS

DESCRIPTION OF THE INVENTION

The object of the present invention to prevent the lock from being picked is achieved for a tumbler lock of the type described above because the side flanks of the window located parallel to the direction of motion of the tumblers are covered in the area of the key channel by protective strips connected to the inner cylinder. As a result, the tumblers are covered on the left and right sides of the key channel. Objects and tools inserted into the key channel can thus no longer be easily wedged on the side flanks of the tumblers and manipulation can only occur over the normally very narrow upper and lower sides of the key channel. The side flank of the windows, which can be reached much more easily with objects inserted into the key channel, are covered therein. Thus, the proposed measure contributes considerably to the locking reliability of a tumbler lock.

A preferred embodiment consists in placing in the rotatable inner cylinder a guide profile into which, after insertion of the tumblers into the guide slots, continuous protective strips are pushed for the simultaneous covering of all the side flanks of the windows provided in the tumbler lock and located in the area of the key guide. Since the protective strips must be located, on the one hand, within the window recesses of the tumblers and, on the other, must be fixedly connected to the rotatable inner cylinder, the insertion of protective strips into a guide profile of the inner cylinder, after insertion of the tumblers, results in simple mounting and in low-cost construction.

Additionally, designs are also possible in which the tumbler lock is made up of individual sections, whose parting surfaces are located in the tumbler area.

Another preferred embodiment consists in using the protective strips in conjunction with an adapted or matched window size as stops for the tumblers in their locked state. Thus, with appropriate selection of the window recesses, the individual tumblers can be plunged at varying depths into the longitudinal recess of the outer cylinder in the locked state. Thus, it would not be possible to lift all the tumblers to the open position, as described in the first example. The lifting of all the tumblers to the open position of the lock is not possible because of the protective strips placed in the key channel and the still accessible upper and lower edges of the tumblers, in conformity with the key profile, already are at different heights. The varying plunging depths proposed herein can be incorporated into the lock as an additional safety measure.

Figure 1:
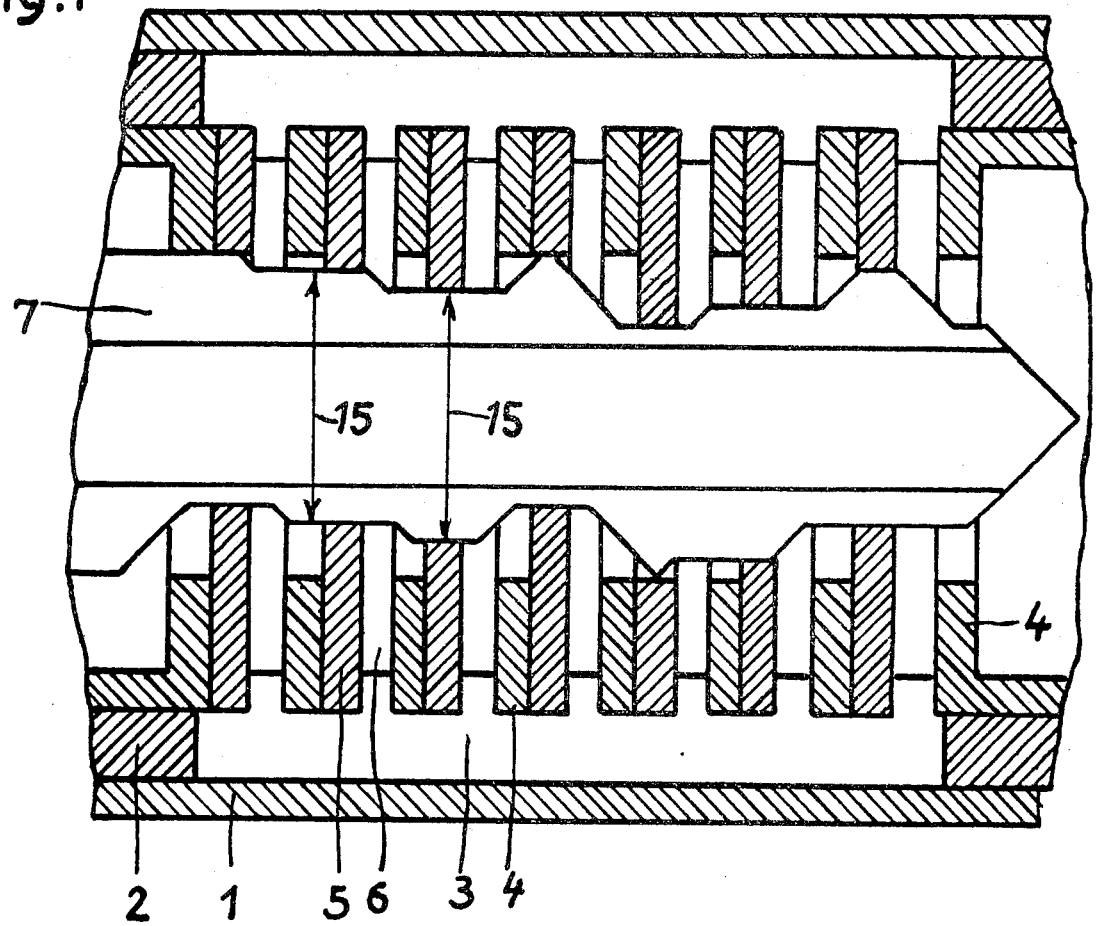
FIG. 1 is a longitudinal sectional view of a tumbler lock with an inserted key illustrating my invention.

The invention will now be described in greater detail with reference made to a practical embodiment. FIG. 1 shows a bolt housing 1 in which an outer cylinder 2 has been securely installed preventing rotation therein. An inner cylinder 4 is mounted in outer cylinder 2 with allowance for rotation. Outer cylinder 2 has longitudinal recesses 3 on the lower and upper side. Plate-type tumblers 5, 6 are placed in guide slots 8 of inner cylinder 4. (In the interest of clarity, tumbler plate 6 is not shown in FIG. 1, only its place in guide slot 8 is indicated). In FIG. 1, a key 7 is inserted into the tumbler lock, causing tumbler plates 5, 6 to be lifted off of the lower longitudinal recess 3 into the open position. They contact on their exteriors with the outer surfaces of the rotatable inner cylinder 4. Key 7 has an identical profile width as best shown at 15 in FIG. 1.

Figure 2:
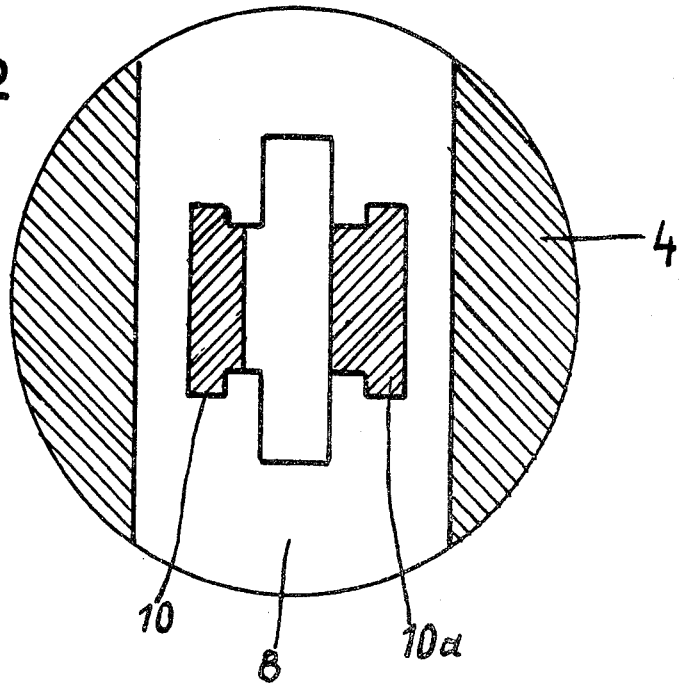
FIG. 2 is a cross-sectional view of the inner cylinder of FIG. 1 further illustrating the inserted protective strips.

In FIG. 2 inner cylinder 4 has been taken out of the lock and a section is taken at the site of a guide slot 8 with the protective strips 10, 10*a* pushed in. Protective strips 10 and 10*a* extend throughout the length of the tumbler lock. FIG. 2 also show profile design of the protective strips 10, 10*a* and a corresponding profile design of the rotatable inner cylinder. Protective strips 10, 10*a* are simply pushed into the profile recess for connection with rotatable cylinder 4.

Figure 3:
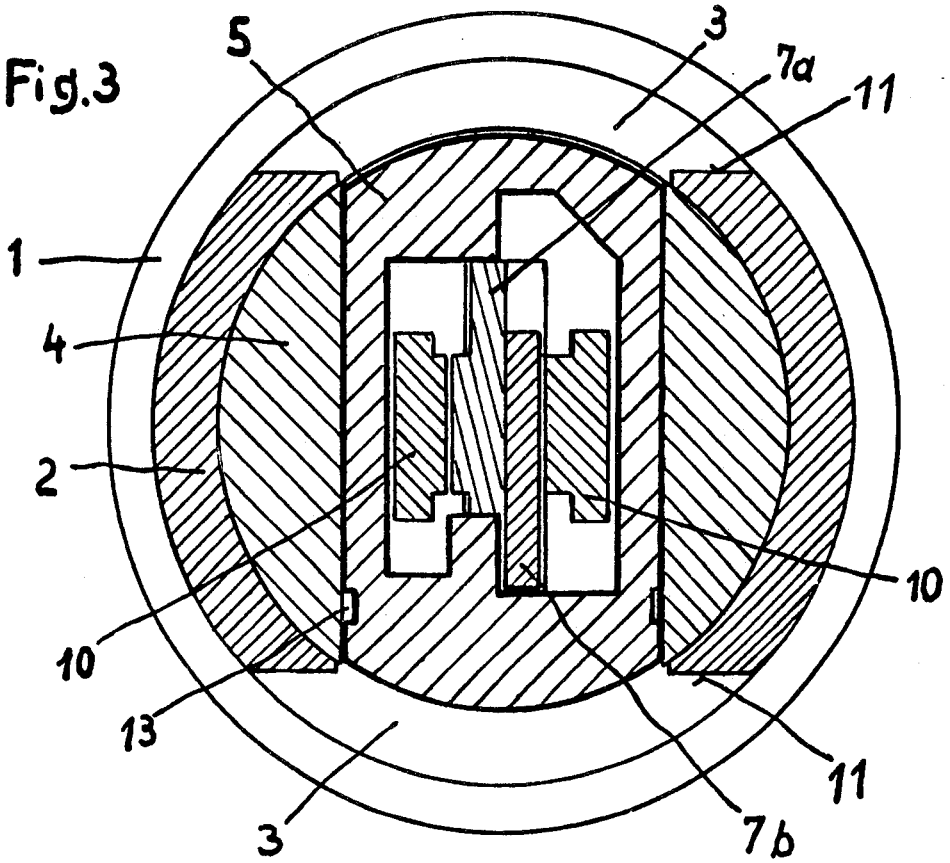
FIG. 3 is a cross-sectional view of the tumbler lock of FIG. 1.

FIG. 3 illustrates a section perpendicular to the tumbler lock at the site of a tumbler with the key inserted therein as shown in FIG. 1. Here, key 7 is a double key with cross-sections *7a* and *7b*. Tumbler plate 5 carries on its lower side face a notch 13 which, in the locked state (FIG. 4), comes to lie opposite an edge 11 of the outer cylinder.

The tumbler lock works as follows: In the locked stated and with the key withdrawn (FIG. 4), tumblers 5, through gravity, have slipped downwards in their guide slots 8 into longitudinal recess 3 of outer cylinder 2. This prevents inner cylinder 4 from turning and, thus, the lock from opening. Now, when key 7 is inserted into the lock, the tumblers are lifted and come to rest within inner cylinder 4 because of the corresponding contours of the key. This cancels the locking of the lock, and the inner cylinder 4 can then be turned by means of the key and the lock can thus be opened.

Figure 4:
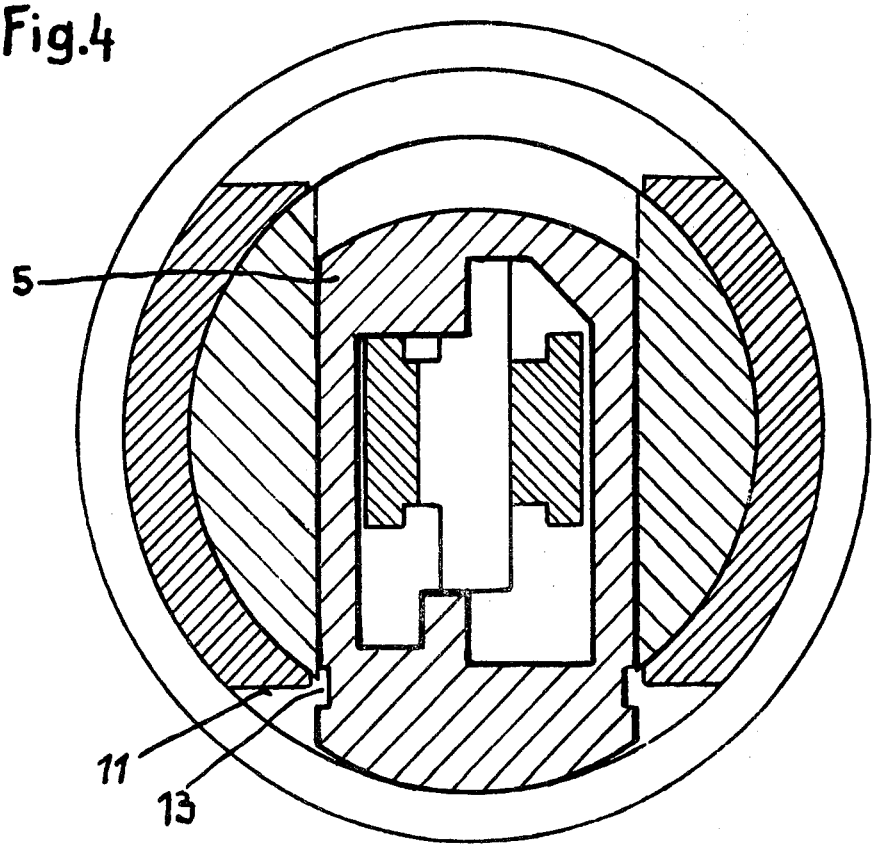
FIG. 4 is a view similar to FIG. 3 but with the key removed, i.e. in the locked state.

It is apparent from FIG. 4 that tampering with tumbler 5 is very difficult because of the pushed-in protective strips 10, 10*a*. The lateral areas of the tumbler windows, which are accessible in other locks, are to a large extent covered by protective strips 10, 10*a* in the area of the key channel in the present invention.

FIG. 4 also shows that protective strips 10, 10*a* can be used as stops for the tumblers which slide downwards. Through appropriate construction of the tumbler windows, the individual tumbler plates can be brought in the locked state at different levels. The tumbler plate shown in FIG. 4 has, for example, with a rotation of 180° when used for the second profile of the double key, a lower plunging depth in longitudinal recess 3.

The notches 13 on the outer edge of tumblers 5 serve as a further protective measure against unauthorized opening through tracing of the tumbler plates. In the representation of FIG. 4, notch 13 hooks on edge 11 when inner cylinder 4 makes a slight rotation. However, this notch allows the inner cylinder to turn slightly, thus possibly enabling the locking edges of the tumbling plates to be traced. To prevent this, the notches are provided only at the end of tumbler plates 5 so that, when this tumbler plate, rotated by 180°, is used as tumbler plate 6 for the opposing key profile of double key 7, inner cylinder 4 can no longer rotate for the amount necessary for successfully tracing the locking edges.

From the foregoing detailed description, it will be evident that there are a number of changes, adaptations and modifications of the present inventions which come within the province of those persons having ordinary skill in the art to which the aforementioned inventions pertain. However, it is intended that all such variations not departing from the spirit of the inventions be considered as within the scope thereof as limited solely by the appended claims.

I claim:

1. A tumbler lock comprising:

an outer cylinder having two longitudinal recesses staggered by 180°, an inner cylinder having guide slots and mounted in said outer cylinder, at least two springless plate-type tumblers associated with said inner cylinder, freely movable in said guide slots and engaging, in the locked state, in one of said longitudinal recesses of said outer cylinder, whereby said inner cylinder is prevented from rotating relative to said outer cylinder, said tumblers being provided with windows for a key and which, during insertion of the key, move in both directions of motion through the key profile from the area of said longitudinal recess to the area of said inner cylinder, the open position, so that said inner cylinder can rotate, and protective strips connected to said inner cylinder, and covering in the area of the key guide the side flanks of said windows which are parallel to the direction of motion of said tumblers, said inner cylinder including a guide profile into which, after insertion of said tumblers, said protective strips can be pushed into said guide slots to cover all the side of flanks of said windows provided in said tumblers and located in the area of the key guide, and said protective strips, in conjunction with a matched window size serving as stops for said tumblers in the locked state, so that the plunging depths of said individual tumblers into said longitudinal recess on said outer cylinder are determined.

2. The tumbler lock according to claim 1 including, said inner cylinder including two longitudinal guide profiles at either side of the vertical flanks of the key slot, said continuous protective strips being inserted into said longitudinal guide profiles, after insertion of said tumblers, and thereby passing through said windows of said tumblers, said protective strips permitting the raising and lowering of said tumblers, and said protective strips forming part of the vertical flanks of said key slot to cover the sides of vertical flanks of said windows provided in said tumblers and located in the area of said key slot.

3. The tumbler lock according to claim 1 including, said windows of said tumblers having upper edges at the upper sides of said windows, said upper edges contacting at least one of said protective strips when said tumblers are in a lowered locked position, and said edges being located at different heights so that the individual plunging depths of said tumblers into said longitudinal recess on said outer cylinder are different.

4. The tumbler lock according to claim 2 including, said windows of said tumblers having upper edges at the upper sides of said windows, said upper edges contacting at least one of said protective strips when said tumblers are in a lowered locked position, and said edges being located at different heights so that the individual plunging depth of said tumblers into said longitudinal recess on said outer cylinder are different.

5. The tumbler lock according to claim 1 including, a key comprising two plates that are connected with plane sides such that said key profile is formed by one projecting longitudinal edge of each said plate, and said inner cylinder and said protective strips forming a key slot that is generally rectangular.

6. The tumbler lock according to claim 2 including, a key comprising two plates that are connected with plane sides such that said key profile is formed by one projecting longitudinal edge of each said plate, and said inner cylinder and said protective strips forming a key slot that is generally rectangular.

7. The tumbler lock according to claim 3 including, a key comprising two plates that are connected with plane sides such that said key profile is formed by one projecting longitudinal edge of each said plate, and said inner cylinder and said protective strips forming a key slot that is generally rectangular.

8. The tumbler lock according to claim 4 including, a key comprising two plates that are connected with plane sides such that said key profile is formed by one projecting longitudinal edge of each said plate, and said inner cylinder and said protective strips forming a key slot that is generally rectangular.

* * * * *